US008990973B2

(12) United States Patent
Graff et al.

(10) Patent No.: US 8,990,973 B2
(45) Date of Patent: Mar. 31, 2015

(54) GRAB BAR ASSEMBLY

(75) Inventors: Andrew James Graff, Greensboro, NC (US); Earl David Forrest, Asheboro, NC (US); Jeffrey Allen DeBoer, Ann Arbor, MI (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 1513 days.

(21) Appl. No.: 12/034,824

(22) Filed: Feb. 21, 2008

(65) Prior Publication Data

US 2009/0211013 A1 Aug. 27, 2009

(51) Int. Cl.

| | |
|---|---|
| ***A47K 3/024*** | (2006.01) |
| ***A47K 17/02*** | (2006.01) |
| ***A47K 3/00*** | (2006.01) |

(52) U.S. Cl.

CPC ..... *A47K 17/022* (2013.01); *A47K 3/003* (2013.01)

USPC ..... 4/576.1; 4/559; 4/611

(58) Field of Classification Search

USPC ..... 256/65.01; 4/576.1, 611, 575.1, 661, 4/559, 572.1; 16/446; 74/551.4; 248/205.1, 310, 315, 340

See application file for complete search history.

(56) References Cited

U.S. PATENT DOCUMENTS

| | | | | |
|---|---|---|---|---|
| 2,059,171 | A * | 10/1936 | Harris | 4/576.1 |
| 2,177,554 | A * | 10/1939 | Stiff | 16/420 |
| 4,162,544 | A * | 7/1979 | Freeman et al. | 4/576.1 |
| 4,662,593 | A * | 5/1987 | Shames et al. | 248/222.14 |
| 5,970,535 | A * | 10/1999 | Wayne | 4/576.1 |
| 6,276,027 | B1 | 8/2001 | Hanna | |
| 6,371,423 | B1 * | 4/2002 | Miller | 211/123 |
| 6,609,689 | B1 * | 8/2003 | Knapp | 248/205.5 |
| 7,107,651 | B1 * | 9/2006 | Lin | 16/444 |
| 7,124,451 | B2 * | 10/2006 | Moore | 4/576.1 |
| 7,203,978 | B1 | 4/2007 | Chang | |
| 7,213,276 | B2 * | 5/2007 | Palma | 4/611 |
| 7,665,706 | B2 * | 2/2010 | Chien et al. | 248/542 |

FOREIGN PATENT DOCUMENTS

| | | |
|---|---|---|
| JP | 2002070279 | 3/2002 |
| JP | 2007138551 | 6/2007 |

OTHER PUBLICATIONS

GB Search Report dated Jun. 4, 2009.

* cited by examiner

*Primary Examiner* — Lauren Crane

(74) *Attorney, Agent, or Firm* — Carlson, Gaskey & Olds, PC

(57) ABSTRACT

A grab bar body is configured to have an overall shape that is defined by an inner peripheral surface and an outer peripheral surface. The grab bar body defines an open center space that is entirely bounded by the inner peripheral surface. In one example, the grab bar body has an overall shape that corresponds to an oval shape, with the open center space having a corresponding oval shape.

30 Claims, 4 Drawing Sheets

GRAB BAR ASSEMBLY

TECHNICAL FIELD

This invention relates to a bar that is utilized in bathrooms, such as a grab bar for example, and more specifically the invention relates to a non-linear grab bar configuration.

BACKGROUND OF THE INVENTION

Grab bars are utilized in bathroom applications to provide support for an individual during exit or entry in a bathtub or shower, for example. Typical grab bars include a linear/straight body member that is spaced apart from, and parallel to, a wall. The grab bar has end mounts that extend toward the wall such that the grab bar can be mounted to the wall. In some configurations, the linear/straight body member may include straight angled portions such that the grab bar can be gripped at different orientations.

The most traditional overall shape of the body member is a single straight linear shape that extends between two mounting points. Optionally, the body member includes a first linear portion and a second linear portion extending at a different angle relative to the first linear portion to form a "V-shape" or L-shape." For example, the first linear portion can comprise a horizontally extending portion and the second linear portion can comprise a vertically extending portion, with one mounting point being located at one end of the horizontally extending portion and a second mounting point being located an opposite end of the vertically extending portion.

One disadvantage with these traditional linear configurations is that they are institutional in appearance. For use in hotels, homes, and other non-institutional-type environments, it is often desirable to have a grab bar that presents an aesthetically appealing appearance. However, configurations deviating from a linear configuration are challenging because they must be able to be easily installed and meet all industry standards, as well as being economical to produce.

SUMMARY OF THE INVENTION

A grab bar for a bathroom is configured to have a grab bar body with an overall shape that is defined by an inner peripheral surface and an outer peripheral surface. The grab bar body defines an open center space that is entirely bounded by the inner peripheral surface.

In one example, the grab bar body has an overall shape that corresponds to an oval shape, with the open center space having a corresponding oval shape.

In one example, the grab bar body has a circular cross-section. The grab bar body is formed from an extrusion, such as an aluminum extrusion for example, that has a hollow tubular shape. The extrusion is bent into a desired overall shape, such as an oval shape for example.

In one example, the grab bar body is formed from first and second pieces. The first piece comprises a flexible piece that is made from injection molded plastic, for example. The second piece comprises a rigid piece that is made from cast aluminum for example. In one configuration, the flexible piece is positioned to be closest to a wall structure and the rigid piece forms a front facing piece that facing opposite the wall structure. The rigid and flexible pieces are secured together via at least one mount interface. Mount assemblies are used to secure the grab bar body to the wall structure.

The subject grab bar provides a grab bar body having an aesthetically pleasing, non-linear, overall shape that can be easily installed, satisfies industry standards, and which is economical to produce. These and other features of the present invention can be best understood from the following specification and drawings, the following of which is a brief description.

DETAILED DESCRIPTION OF THE PREFERRED EMBODIMENT

Figure 1:
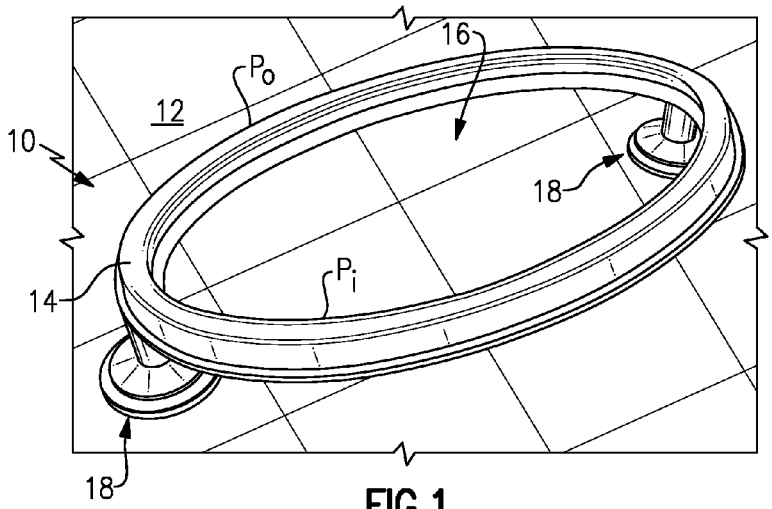
FIG. 1 is a perspective view of a grab bar assembly.

A grab bar assembly 10 for attachment to a bathroom wall structure, such as a wall 12 of a tub or shower is shown in FIG. 1. The grab bar assembly 10 includes a grab bar body 14 with an overall shape that is defined by an inner peripheral surface Pi and an outer peripheral surface Po that is radially spaced from the inner peripheral surface Pi. The grab bar body 14 defines an open center space 16 that is entirely bounded by the inner peripheral surface Pi.

As such, the grab bar body 14 is configured to have looped or ring configuration, i.e. a non-linear shape. In the example shown in FIG. 1, the grab bar body 14 has an overall shape that is oval with a corresponding open center space that is oval; however other bounded shapes could also be formed by the grab bar body 14. For example, the grab bar body could be configured to have a triangular shape or square/rectangular shape, with corresponding open spaces that would be triangular or square/rectangular shape.

Mounting assemblies 18 are used to secure the grab bar body 14 to the wall structure 12. In the example shown in FIG. 1, two mounting assemblies 18 are shown; however, it should be understood that a single mounting assembly could be used, or additional mounting assemblies could be used, depending upon the overall configuration of the grab bar assembly.

In this example configuration, the grab bar body 14 comprises a clamshell design where first 20 and second 22 pieces are secured together to create a desired overall shape, which in this example is an oval shape. Due to load bearing requirements defined by industry standards, this shape would not have been possible using a traditional bent, formed, and welded extrusion. This is due to the thick wall sections that would be required for load bearing purposes, and the fact that in forming non-circular sections there is material displacement that causes cracks and unappealing surface defects. To avoid these problems, and to provide the desired overall shape, the grab bar body 14 uses a two-piece configuration.

In the example shown, the first piece 20 comprises a hollow inner piece that is closest to the wall structure 12 and the second piece 22 comprises a hollow outer piece that provides a front viewable face that faces opposite from the wall structure 12. The first 20 and second 22 pieces are made from different materials and are made using different forming methods. The first piece 20 comprises a flexible structure and the second piece 22 comprises a rigid structure.

In one example, the second piece 22 is made from a structural material, which is used to handle load bearing requirements. For example, the second piece 22 could be made from cast aluminum; however, other suitable rigid/structural materials could also be used. In one example, the first piece 20 is made from an injection molded plastic such that the first piece 20 provides some flexibility for alignment and adjustment purposes. The first piece 20 is decorative in nature and does not perform load bearing functions, thus use of a plastic material helps to reduce the overall cost of the grab bar assembly 10; however, other suitable flexible materials could also be used.

Due to the use of two different materials to form the grab bar body 14, an interlocking feature is required to align the first 20 and second 22 pieces relative to each other. The interlocking feature is required to prevent perimeter walls of the first 20 and second 22 pieces from becoming misaligned during assembly, which would cause a step formation between the two pieces. The interlocking feature will be discussed in greater detail below.

Additionally, it is important to have proper alignment between the grab bar body 14 and the mounting assembly 18. Alignment at this interface is important such that loads are fed through a defined path to ensure predictable performance results.

Figure 2:
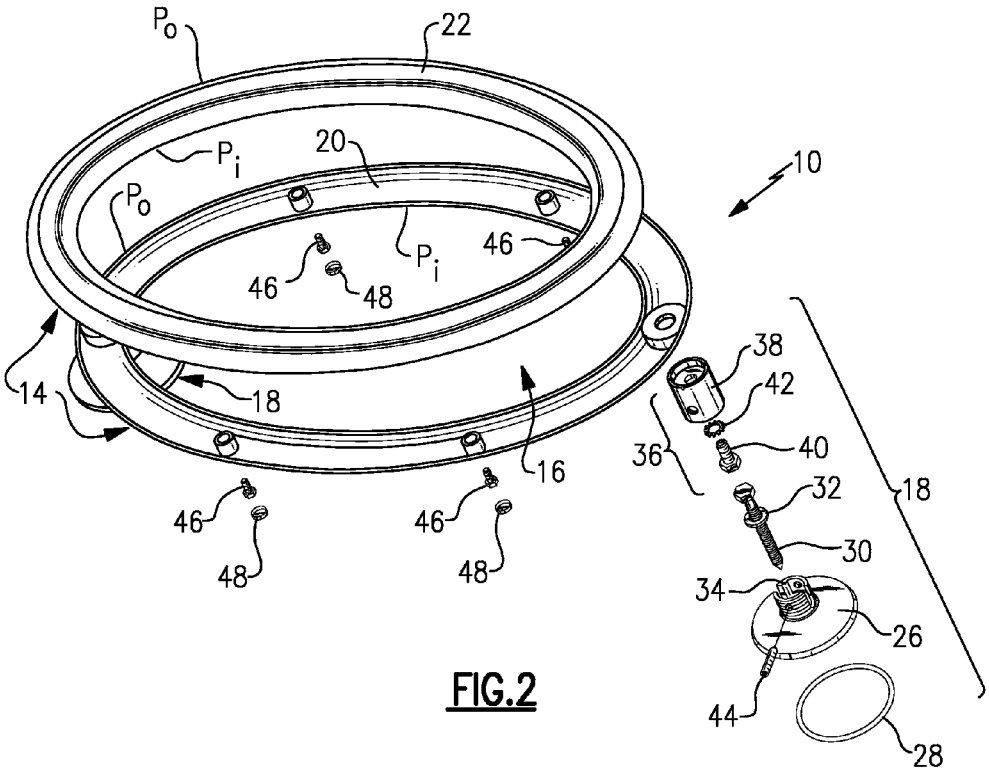
FIG. 2 is an exploded view of the grab bar assembly of FIG. 1.

The mounting assembly 18 is shown in greater detail in FIG. 2. The mounting assembly includes a base flange 26 with an o-ring 28, a fastener 30 and washer 32 that is installed through a center bore 34 in the base flange 26, and a post assembly 36. The post assembly 36 provides an interface to the first 20 and second 22 pieces and includes a post sleeve 38, a fastener 40, and an associated washer 42. A set screw 44 is used to secure the base flange 26 to the post sleeve 38.

Fasteners 46 are used to secure the first 20 and second 22 pieces to each other. Four (4) such fasteners 46 are shown in FIG. 2. It should be understood that fewer or additional fasteners could be used depending upon the overall shape and size of the grab bar body 14. Caps 48 are used to cover heads of the fasteners 46 when installed.

Figure 3:
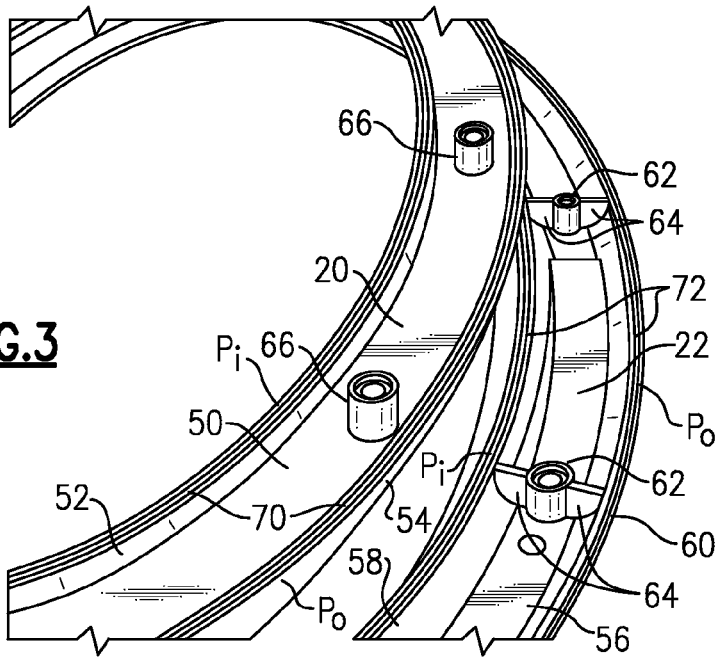
FIG. 3 is a partial perspective view of first and second pieces used to form a grab bar body as shown in FIG. 2.

The interlocking feature for the first 20 and second 22 pieces is shown in greater detail in FIG. 3. The interlocking feature includes two different mounting interfaces. As discussed above, the first piece 20 comprises a hollow structure and includes a general C-shape configuration with an inner base surface 50 having first 52 and second 54 walls extending outwardly from the base surface 50 to form a C-shape. The second piece 22 also comprises a hollow structure having a general C-shape configuration. As such, the second piece 22 includes an inner base surface 56 and first 58 and second 60 walls extending outwardly from the inner base surface 56 to form the C-shape. The first 52 and second 54 walls of the first piece 20 are aligned with the first 58 and second 60 walls of the second piece 22.

To assist in initial alignment of the first 20 and second 22 pieces, the second piece 22 includes a plurality of threaded posts 62 that extend slightly beyond a wall height of the second piece 22. Each threaded post 62 is supported on opposing sides by ribs 64. Each rib 64 extends from an outer surface of the threaded post 62 to contact one of the first 58 and second 60 walls. The first piece 20 includes a counter bore 66 for each of the threaded posts 62. The counter bores 66 do not include ribs like those associated with the threaded posts 62. As such the counter bores 66 are free-standing with air gaps formed between an outer surface of each counter bore 66 and the first 52 and second 54 walls. This facilitates the flexibility of the first piece 20 to ensure self-alignment between the first 20 and second 22 pieces. The fasteners 46 are inserted through the counter bores 66 and are threaded into the threaded posts 62 to secure the first 20 and second 22 pieces together. Thus, the threaded posts 62, counter bores 66, and fasteners 46 form one of the mounting interfaces for the interlocking feature.

The other mounting interface for the interlocking feature includes a groove and rib configuration. The first 20 and second 22 pieces each define a portion of the inner peripheral surface Pi and the outer peripheral surface Po. The first 52 and second 54 walls of the first piece 20 each have a groove 70 formed within a distal end face of the walls. The grooves 70 extend peripherally about the first 52 and second walls 54 as shown. The first 58 and second 60 walls of the second piece 22 each have a rib 72 formed within a distal end face of the walls. The ribs 72 extend peripherally about the first 58 and second 60 walls similar to that of the grooves 70.

When the fasteners 46 are inserted through the counter bores 66 and threaded into the threaded posts 62 to assemble the first 20 and second pieces together, the ribs 72 on the second piece 22 align with the corresponding grooves 70 on the first piece 20. Any slight deformation in the first piece 20 is compensated for by the self-centering features, which comprise the grooves 70 and ribs 72.

Figure 4:
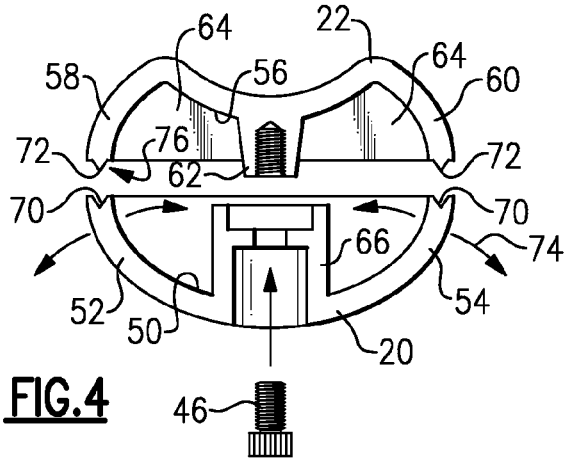
FIG. 4 is a cross-sectional view of the grab bar body.

In one example, the grooves 70 and ribs 72 have corresponding triangular shapes, see FIG. 4. This basic shape provides a finite point at which the first 52 and second 54 walls of the first piece 20 will seek the center of the first 58 and second 60 walls of the second piece 22. Flexibility of the first piece 20 for this purpose is indicated by arrows 74 in FIG. 4.

It should be understood that while threaded posts 62 are shown on the second piece 22 and counter bores 66 are shown on the first piece 20, the reverse configuration could also be used with the bores being located in the second piece and the posts being located in the first piece. Further, a reverse configuration for the groove and rib configuration could also be used, with grooves formed in the second piece and ribs formed in the first piece.

One advantage of using ribs 72 in the second piece 22 relates to the casting method used to form the second piece 22. When ribs are formed in the first piece and grooves are formed in the second piece, which is the reverse configuration to that shown in FIG. 3, casting difficulties result. A significant number of defects can be produced when the casting (second piece) is separated from a feeder and gate material. Gates have to be located at edges of the casting, which makes it difficult to avoid breaking off material that is not intended to be removed, consistently resulting in castings with gaps or voids around the parting line between the two pieces.

In the configuration shown in FIGS. 3 and 4, the ribs 72 are formed within end faces of the walls 58, 60 of the second piece 22. Gates are located at an apex of the triangular shaped rib 72, as indicated at 76. By positioning the gates at the apex, they are easily removed and any extra material that is removed will not be seen as it will be internally hidden within the assembly. Thus, it is advantageous from a manufacturing aspect to form the ribs 72 in the second piece 22 and the grooves 70 in the first piece 20.

Figure 5:
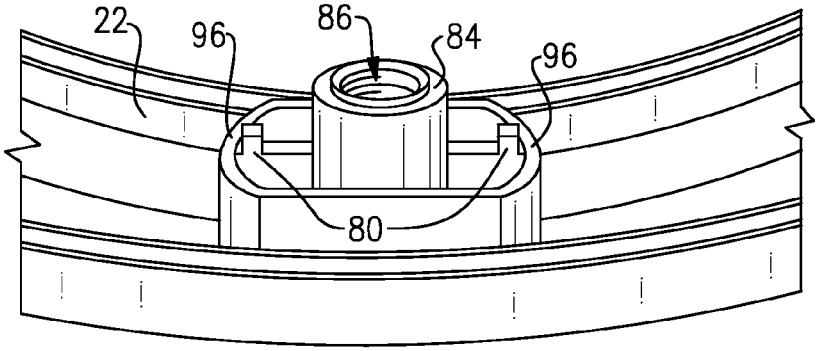
FIG. 5 is a perspective view of a portion of one grab bar body piece at a mount interface.
Figure 6:
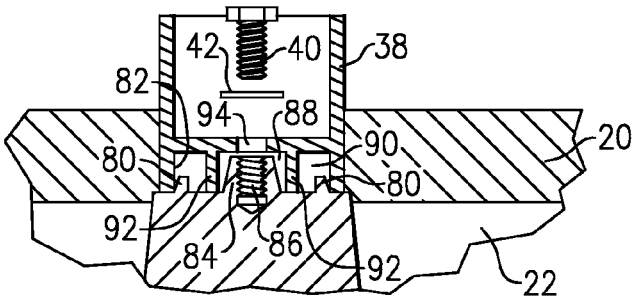
FIG. 6 is a schematic cross-sectional view of a mounting post as installed in the first and second pieces.

As discussed above, it is also important to provide accurate positioning between the post sleeve 38 relative to the second piece 22. Accurate positioning of the post sleeve 38 ensures that loads will be focused through a defined path to provide predictable and consistent performance results. For each mounting assembly 18, the second piece 22 includes a pair of alignment tabs 80 as shown in FIG. 5. The tabs 80 have tapered outer edges that interface with an inner surface 82 of the post sleeve 38 (FIG. 6), which maintains accurate position of the post sleeve 38 during assembly.

Between the tabs 80 a post 84 with a threaded bore 86 is provided. The post 84 is received within a first recess 88 formed within the post sleeve 38. The tabs 80 are received within a second recess 90 that is radially spaced outward relative to the first recess 88. Walls 92 separate the first 88 and second 90 recesses. The fastener 40 and associated washer 42 are inserted through an opening 94 in the post sleeve 38 and into the threaded bore 86 to secure the post sleeve 38 to the second piece 22.

The post sleeve 38 is also used to clamp the first piece 20 to the second piece 22. By adding material to the first piece 20 at a point where the post sleeve 38 interfaces with the first piece 20, clamping pressure generated by attachment of the post sleeve 38 to the second piece 22 can be used advantageously. A post support 96 (FIGS. 5 and 7) is formed with the second piece 22. The post support 96 is comprised of a pair of arcuate portions that are separated from each other, i.e. the post support 96 does not form a complete circle. A corresponding shape with two surfaces 98 is formed within the first piece 20. These surfaces 98 can withstand the clamping pressure without interfering with the solid interface between the post sleeve 38 and the post support 96.

Figure 7:
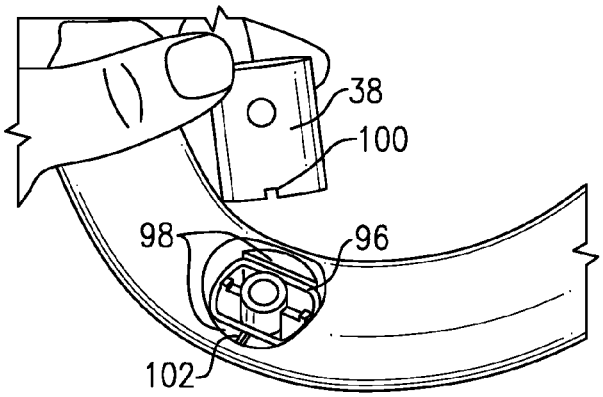
FIG. 7 is a perspective view similar to that of FIG. 6 but showing the mounting post in an uninstalled position.

To maintain the correct position of the post sleeve 38 to the first 20 and second 22 pieces, a small notch 100 is formed within the post sleeve 38, as shown in FIG. 7. The notch 100 interfaces with a rib 102 that is formed on one of the surfaces 98 of the first piece 20 (FIG. 7).

Another example of a grab bar assembly 200 is shown in FIGS. 8-12. This example is similar to that of FIGS. 1-7 in that a grab bar body 202 has an overall shape that is oval, triangular, square, etc. as discussed above. However, in this example, the grab bar body 202 is formed from a single piece instead of comprising a two-piece design.

Figure 8:
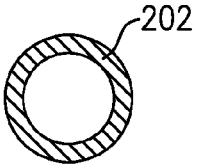
FIG. 8 is a cross-sectional view of another example of a grab bar body.
Figure 9:
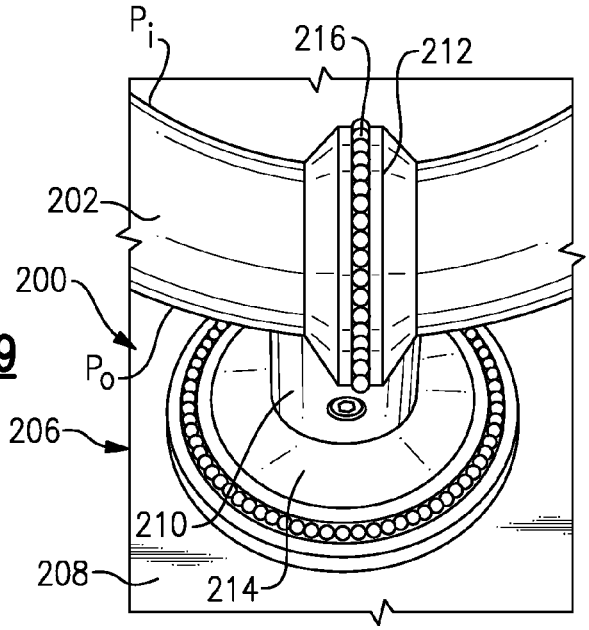
FIG. 9 is a perspective view of a mount interface for the grab bar body of FIG. 8.

The grab bar body 202 is comprised of an extrusion that is circular and hollow in cross-section as shown in FIG. 8. An aluminum material or other suitable material can be used to form the extruded component. As such, the grab bar body 202 is first formed as a tube, which is then easily bent and formed into a desired overall shape, such as an oval shape for example. The grab bar body 202 has an inner peripheral surface Pi and an outer peripheral surface Po that is spaced radially outward relative to the inner peripheral surface Pi. As such, an open center space 204 is provided that is entirely bounded by the inner peripheral surface Pi. A shape of the open center space 204 corresponds generally to the overall shape of the grab bar body 202.

To create an oval shape, the tube is first formed into a circle, and then abutting ends are butt-welded to form a ring or donut shape. The ring is then reformed to create the oval shape. Mounting assemblies 206 are used to secure the grab bar body 202 to a wall structure 208. It should be understood that while two mounting assemblies 206 are shown for the configuration set forth in FIGS. 8-12; fewer or additional mounting assemblies could be used as needed.

The mounting assemblies 206 each include three main components: a first collar piece 210; a second collar piece 212; and a base flange 214. To reduce overall tooling costs, one main casting die is used for each of these components. These individual dies have interchangeable design elements that are simple inserts 216 that can be removed or added as needed for a particular design configuration. In the example shown in FIG. 9, a beaded insert 216 is shown; however, this could be easily replaced with another patterned insert for a different look. Thus, new looks can be created without significant additional tooling costs.

Industry standards require that the grab bar body 202 cannot rotate within associated fixing points, which are located at the mounting assemblies 206. A collar assembly including the first 210 and second 212 collar pieces is used that closely follows a trajectory of a grab bar path. This provides a consistent gap between the grab bar and the collars.

Figure 10:
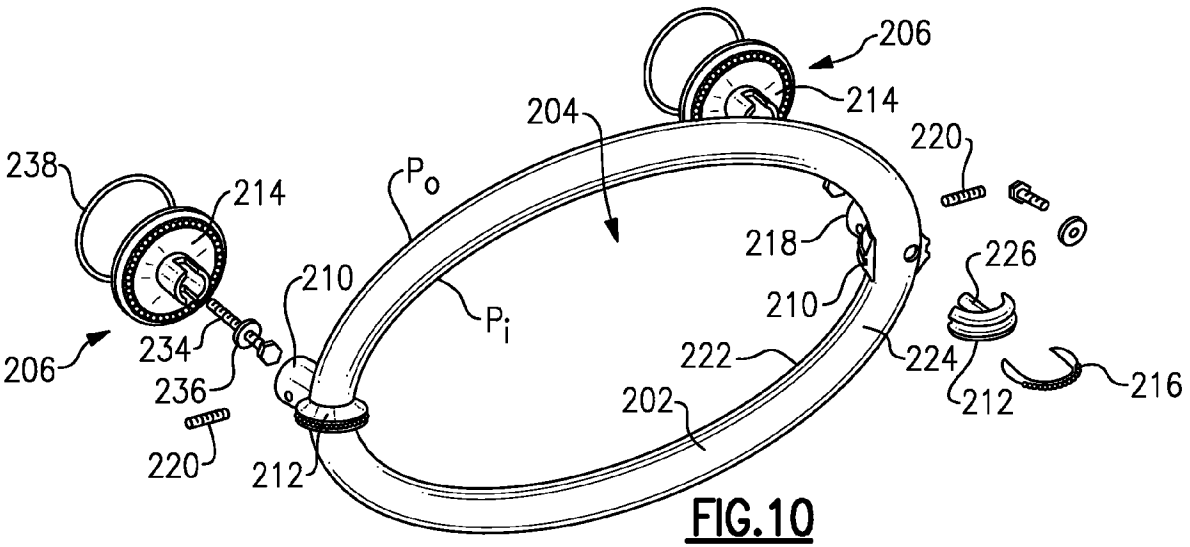
FIG. 10 is an exploded view of a grab bar assembly for the grab bar body of FIG. 8.

As shown in FIG. 10, the first collar piece 210 includes a sleeve portion 218 that interfaces with the base flange 214. A set screw 220 is used to secure the sleeve portion 218 to the base flange 214. The first collar piece 210 is associated with a wall facing side 222 of the grab bar body 202, while the second collar piece 212 is associated with a front facing side 224 of the grab bar body 202.

Figure 11:
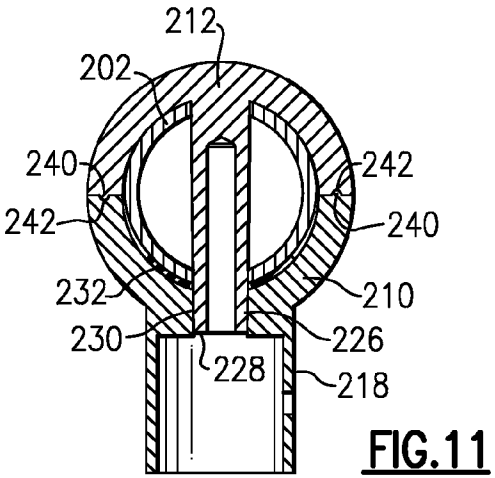
FIG. 11 is a cross-sectional view of the mount interface of FIG. 9.

In order to hold the grab bar body 202 securely in place within the fixing points, the second collar piece 212 includes an internally threaded post 226 that is of sufficient length to pass entirely through both sides of the grab bar body 202 and that receives threaded fastener 244. A washer 246 is associated with the fastener 244. A distal end 228 of the threaded post 226 is then press-fit into an opening 230 in the first collar piece 210 (FIG. 11). The press-fit interface is needed to satisfy industry standards for load bearing requirements.

To accommodate for normal manufacturing tolerances, any remaining space between the grab bar body 202 and the collar pieces 210, 212 is taken up by a resilient washer 232. A fastener 234 and washer 236 extend through the base flange 214 to secure the grab bar assembly 200 to the wall structure 208. An o-ring 238 is associated with the base flange 214 to provide a sealed interface.

Alignment between the second collar piece 212 and the first collar piece 210 is controlled by the use of dome features 240 that engage into corresponding socket features 242. In the example shown, four of each of these features is used; however other numbers could also be used. To assist in manufacturing and assembly, the dome 240 and socket 242 features are positioned such that they only have one way in which they will correctly align. This is achieved by positioning both sockets and domes on the same collar piece and reversing the detail for the mating component. This feature is of particular importance when the trajectory is a very large radius and resembles a straight line at a glance.

Figure 12:
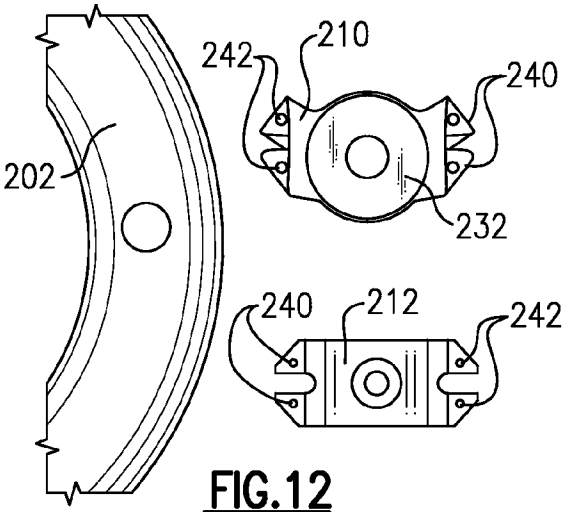
FIG. 12 shows mating end faces of first and second collar pieces.

In the example shown in FIGS. 11-12, the second collar piece 212 includes two dome features 240 (one is shown in FIG. 11) and two socket features 242 (one is shown in FIG. 11). The first collar piece 210 also includes two dome features 240 (only one is shown in FIG. 11) and two socket features 242 (only one is shown in FIG. 11).

The dome features 240 and socket features 242 cooperate to prevent the first 210 and second 212 collar pieces from rotating and becoming misaligned with respect to each other. Once tightened, there may be some space between the grab bar body 202 and the collar pieces 210, 212. This additional space is taken up by the resilient washer 232.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A bathroom grab bar assembly comprising:

a grab bar body having an overall shape defined by an outer peripheral surface and an inner peripheral surface, said grab bar body defining an open center space that is entirely bounded by said inner peripheral surface, and wherein said grab bar body is comprised of a first piece positionable to face a wall structure and a second piece facing outwardly away from said wall structure, said first and second pieces each forming a portion of the inner peripheral surface; and at least one mount assembly attached to said grab bar body, said at least one mount assembly configured to attach said grab bar body to a wall structure such that said grab bar body does not move relative to the wall structure when attached.

2. The bathroom grab bar assembly according to claim 1 wherein said overall shape comprises an oval shape, and wherein each of said first and second pieces comprise oval-shaped pieces such that the open center space comprises an oval-shaped opening that is solely bounded by the inner peripheral surfaces of the first and second pieces.

3. The bathroom grab bar assembly according to claim 1 wherein said grab bar body has a non-circular cross-section.

4. The bathroom grab bar assembly according to claim 1 wherein said grab bar body has a circular cross-section.

5. The bathroom grab bar assembly according to claim 1 wherein said first and second pieces are secured together with at least one mount interface.

6. A bathroom grab bar assembly comprising:

a grab bar body having an overall shape defined by an outer peripheral surface and an inner peripheral surface, said grab bar body defining an open center space that is entirely bounded by said inner peripheral surface, and wherein said grab bar body comprises a first piece positionable to face a wall structure and a second piece facing outwardly away from said wall structure, said first and second pieces being secured together with at least one mount interface; and at least one mount assembly attached to said grab bar body, said at least one mount assembly configured to attach said grab bar body to a wall structure such that said grab bar body does not move relative to the wall structure when attached, and wherein said first piece is comprised of a flexible material and said second piece is comprised of a rigid material.

7. The bathroom grab bar assembly according to claim 6 wherein said first piece is comprised of plastic and said second piece comprises a cast component.

8. The bathroom grab bar assembly according to claim 6 wherein said at least one mount interface comprises one of said first and second pieces including a post and the other of said first and second pieces including a counter bore to align with said post, and wherein a fastener is inserted through said post and counter bore to secure said first and second pieces together.

9. The bathroom grab bar assembly according to claim 8 wherein said first piece includes said counter bore and said second piece includes said post, and wherein said second piece includes a rib structure extending from an outer surface of said post to an inner surface of said second piece.

10. The bathroom grab bar assembly according to claim 8 wherein said first piece includes a first mating surface extending about a periphery of said first piece and wherein said second piece includes a second mating surface extending about a periphery of said second piece that mates with said first mating surface, and wherein one of said first and second mating surfaces comprises a groove and the other of said first and second mating surfaces comprises a rib that fits within said groove to align said first and second pieces together.

11. The bathroom grab bar assembly according to claim 8 including at least one mount assembly adapted to secure said grab bar body to the wall structure, said at least one mount assembly including a base flange to be associated with a surface of the wall structure and a post sleeve that fits within said first piece, said post sleeve being secureable to said base flange with a set screw.

12. The bathroom grab bar assembly according to claim 11 wherein said second piece includes at least one alignment tab that cooperates with an inner surface of said post sleeve to align said post sleeve relative to said first and second pieces.

13. A method of forming a bathroom grab bar assembly comprising the steps of:

forming a grab bar body to have an overall shape defined by an outer peripheral surface and an inner peripheral surface, the grab bar body including a first piece secured to a second piece such that the first piece forms one portion of the inner peripheral surface and the second piece forms a remaining portion of the inner peripheral surface;

defining an open center space that is entirely bounded by the inner peripheral surface; and attaching at least one mount assembly to the grab bar body, the at least one mount assembly configured to attach the grab bar body to a wall structure such that the grab bar body does not move relative to the wall structure when attached.

14. The method according to claim 13 including forming the overall shape as an oval shape with each of the first and second pieces comprising oval-shaped pieces such that the open center space comprises an oval-shaped opening that is solely bounded by the inner peripheral surfaces of the first and second pieces.

15. The method according to claim 13 including providing the first piece as a rigid front facing piece and providing the second piece as a flexible wall facing piece, and securing the rigid front facing piece and flexible wall facing piece together with at least one fastener to form the grab bar body.

16. The method according to claim 13 including providing the mounting assembly with a base flange having a center bore and at least one threaded fastener received within the center bore and configured to secure the base flange to the wall structure.

17. The method according to claim 16 wherein the at least one fastener comprises at least a first fastener to secure the base flange to the wall structure and a second fastener and including providing the mounting assembly with a sleeve that is positioned in an overlapping relationship with a portion of the base flange that defines the center bore such that the sleeve is concentric with the center bore, and fastening the sleeve to the grab bar body with the second fastener.

18. The method according to claim 17 wherein the first fastener comprises a single fastener that is installed into the wall structure in a first direction and including securing the sleeve to the base flange with a third fastener that is installed in a second direction transverse to the first direction.

19. The bathroom grab bar assembly according to claim 1 wherein said mounting assembly includes a base flange having a center bore and at least one fastener received within the center bore and configured to secure the mounting assembly to the wall structure.

20. The bathroom grab bar assembly according to claim 19 wherein the at least one fastener comprises a single threaded fastener.

21. The bathroom grab bar assembly according to claim 19 wherein said at least one fastener comprises at least a first fastener and a second fastener, and wherein said mounting assembly includes a sleeve that that is positioned in an overlapping relationship with a portion of the base flange that defines the center bore such that the sleeve is concentric with the center bore, and wherein the sleeve is fastened to said grab bar body with said second fastener.

22. The bathroom grab bar assembly according to claim 21 wherein said first fastener is configured to extend through the center bore and into the wall structure in a first direction and including a third fastener that secures said sleeve to said base flange, said third fastener extending in a second direction transverse to said first direction.

23. The bathroom grab bar assembly according to claim 6 wherein said outer peripheral surface is defined by a wall facing portion formed of said flexible material and a non-wall facing portion formed of said rigid material.

24. A method of forming a bathroom grab bar assembly comprising the steps of:

forming a grab bar body to have an overall shape defined by an outer peripheral surface and an inner peripheral surface;

defining an open center space that is entirely bounded by the inner peripheral surface;

securing a first bar portion to a second bar portion to form the grab bar body, the first bar portion being formed from a first material and the second bar portion being formed from a second material different than the first material; and attaching at least one mount assembly to the grab bar body, the at least one mount assembly configured to attach the grab bar body to a wall structure such that the grab bar body does not move relative to the wall structure when attached.

25. The method according to claim 24 including forming the first bar portion from a plastic material and the second bar portion from a non-plastic material, the first bar portion comprising a wall facing side of the grab bar body and the second bar portion forming a non-wall facing side of the grab bar body, and with the first and second bar portions each forming a portion of the inner peripheral surface.

26. The method according to claim 24 including defining the open center space of an overall outer shape to be completely open by forming the open center space to be solely bounded by the inner peripheral surfaces of the first and second bar portions.

27. The bathroom grab bar assembly according to claim 1 wherein said open center space of an overall outer shape is solely bounded by the inner peripheral surfaces of said first and second pieces such that said open center space is completely open.

28. The bathroom grab bar assembly according to claim 6 wherein said open center space of an overall outer shape is solely bounded by the inner peripheral surfaces of said first and second pieces such that said open center space is completely open.

29. The method according to claim 13 including defining the open center space of an overall outer shape to be completely open by forming the open center space to be solely bounded by the inner peripheral surfaces of the first and second pieces.

30. The bathroom grab bar assembly according to claim 6 wherein said overall shape comprises an oval shape, and wherein each of said first and second pieces comprise oval-shaped pieces such that the open center space comprises an oval-shaped opening that is solely bounded by the inner peripheral surfaces of the first and second pieces.

* * * * *